United States Patent [19]

Brown

[11] Patent Number: 4,626,641

[45] Date of Patent: Dec. 2, 1986

[54] FRUIT AND MEAT PIE MICROWAVE CONTAINER AND METHOD

[75] Inventor: Richard K. Brown, Appleton, Wis.

[73] Assignee: James River Corporation, Norwalk, Conn.

[21] Appl. No.: 678,216

[22] Filed: Dec. 4, 1984

[51] Int. Cl.[4] ..... H05B 6/80

[52] U.S. Cl. ..... 219/10.55 E; 219/10.55 M; 219/10.55 F; 426/107; 426/243; 99/DIG. 14

[58] Field of Search ..... 219/10.55 E, 10.55 M, 219/10.55 F, 10.55 R, 387; 426/107, 113, 241, 243, 114, 124; 99/DIG. 14, 451

[56] References Cited

U.S. PATENT DOCUMENTS

| | | | |
|---|---|---|---|
| 3,865,301 | 2/1975 | Pothier et al. | 99/DIG. 14 X |
| 3,974,354 | 8/1976 | Long | 219/10.55 E |
| 4,081,646 | 3/1978 | Goltsos | 219/10.55 E |
| 4,134,004 | 1/1979 | Anderson et al. | 219/387 |
| 4,190,757 | 2/1980 | Turpin et al. | 219/10.55 E |
| 4,267,420 | 5/1981 | Brastad | 219/10.55 E |
| 4,283,427 | 8/1981 | Winters et al. | 426/107 |
| 4,337,116 | 6/1982 | Foster et al. | 219/10.55 E X |
| 4,351,997 | 9/1982 | Mattisson et al. | 426/107 X |
| 4,362,917 | 12/1982 | Freedman et al. | 219/10.55 E |

*Primary Examiner*—Philip H. Leung

*Attorney, Agent, or Firm*—Sixbey, Friedman & Leedom

[57] ABSTRACT

A container (2) including a paperboard carton (4) for uniformly heating and crisping the top crust of a large food product such as a pot pie having no side and bottom crusts in a microwave oven including a top panel (9) having crisping means (10) separated by a vertical distance of less than 2.7 centimeters from the top surface of the food product. The crisping means (10) consists of a microwave interactive layer for converting microwave energy received on the inner and outer surfaces of the layer into radiant heat for browning and crisping the top surface of the food product. Crisping means (10) also reflects heat radiated by the top surface of the food product back onto that surface for additional browning and crisping. Uniformity of heating is provided by partially shielding the food product during its exposure to microwave energy, thereby also preventing overheating, loss of mass and changes in texture.

19 Claims, 14 Drawing Figures

FRUIT AND MEAT PIE MICROWAVE CONTAINER AND METHOD

DESCRIPTION

1. Technical Field

This invention relates to food packaging suitable for use in a microwave oven and particularly relates to a container in which foods having crusts, such as fruit and meat pies, may be shipped, displayed, stored, cooked and served.

2. Background Art

The marriage of microwave cooking and preprocessed food products would appear to promise the alluring advantages of convenience and quick results which could be accentuated if such food products were shipped, displayed, cooked and served in the same package. Unfortunately, these alluring advantages are illusory because certain types of food products when heated by microwaves lack many of the characteristics which consumers have come to associate with such products when heated in conventional ovens. The configuration and materials of the package can have a substantial effect upon the results of microwave cooking, but no package has been found which produces entirely satisfactory results when used during microwave cooking of food products having substantial bulk and high volume to surface ratios. Particularly unsatisfactory results occur when such food products have dough crusts on their tops and/or sides and bottom, such as pot pies. To be acceptable, such cooked products must be internally heated without overcooking and must be browned on top, and, if a crust is present, they must be both crisp and brown while avoiding both an overcooked, dried, scorched, burned or charred effect and an undercooked, cold, doughy effect.

One attempt to produce a container to solve many of the problems discussed above is disclosed in the patent to Turpin (U.S. Pat. No. 4,190,757). This patent teaches that browning of a food product such as fruit pies (FIG. 7) can be obtained in microwave cooking by placing the food product adjacent to a lossy microwave energy absorber combined with an adjacent layer of microwave reflective material and allowing heat generated during exposure to microwave energy to conductively crisp or brown the adjacent food surface. The interior of the food product is heated by direct exposure to microwaves through a hole placed in the cover of the food package. However, this container fails to provide a serving dish separate from an outer carton in which the food product is shipped, displayed and heated and also fails to provide or suggest any technique for shielding one portion of the food product from excessive microwaves while allowing sufficient microwave energy to reach a microwave interactive layer designed to brown and/or heat selected portions of the food product as desired.

Although a number of patents, such as those to Brastad (U.S. Pat. No. 4,267,420), Pothier (U.S. Pat. No. 3,865,301) and Goltsos (U.S. Pat. No. 4,081,646), disclose food packages for the controlled and/or selective heating of food in microwave ovens, none of these packages is suitable both for uniformly heating contents having a large mass and for browning and crisping only a top dough crust without the risk of scorching while permitting the dough to move or rise naturally. Yet a further effort to produce a package surmounting these problems is disclosed in the patent to Mattisson et al (U.S. Pat. No. 4,351,997) in which a tray made of either paperboard or a thermoformed plastic material includes peripheral walls coated with a microwave radiation reflecting material and a bottom wall transparent to microwave energy. This package directs more microwave energy into the center of the food product contained therein to achieve uniform heating while also allowing direct heating of both the top and bottom of the product. However, in order to achieve a brown and crisp top crust with this package, exposure to heat produced by a conventional convection or household oven or to radiation from an IR grill in a microwave oven is required.

Thus, it has remained an elusive goal in the microwave container art to produce a "cook-in" container for refrigerated or frozen food having substantial bulk and/or high volume to surface area ratios such as foods containing fillings having top crusts wherein the container is inexpensive, simple to manufacture, disposable and capable of heating the filling uniformly throughout while simultaneously satisfactorily browning and crisping a top crust.

DISCLOSURE OF THE INVENTION

It is the primary object of the subject invention to overcome the deficiencies of the prior art by providing a microwave container for heating a food product having substantial bulk and/or high volume to surface ratios such as foods containing fillings and/or a top crust, while at the same time browning and crisping the top of the food.

Yet another object of this invention is to provide a container for browning and crisping the top surface of food products in a microwave oven, wherein the container includes a crisping means separated from the top surface of the food product to be browned and crisped by a vertical distance which is determined by the thickness of a crust covering the food surface and by the amount by which this crust will expand during the cooking process.

Yet a further object of this invention is to provide a method for uniformly heating a food having a doughy crust contained therein for browning and crisping the doughy crust of said food product by erecting a container having a microwave interactive layer capable of converting microwave energy into heat, exposing the container to microwave energy, removing the the container and further exposing the food to microwave energy.

The above objects may be achieved by a container designed in accordance with the subject invention, wherein the container includes a crisping means formed by a microwave interactive layer separated by a predetermined vertical distance from the top of the food surface which converts microwave energy impinging on both the inner and outer surfaces of the layer into heat for browning and crisping the top surface of the food product. The container has an insert which contains the food product to be heated and which insert includes a microwave transparent area in its bottom panel to admit microwave energy into the bottom of the insert, and, consequently, the bottom of the food product held therein. The insert is otherwise shielded on its side and bottom to prevent excessive exposure of the food product to direct microwave energy. Such partial shielding provides the ability to control the amount of microwave energy entering and heating the food product independently from the heat generated by the microwave interactive layer.

Other and more specific objects of the invention may be understood from the following Brief Description of the Drawings and Best Mode for Carrying Out the Invention.

BEST MODE FOR CARRYING OUT THE INVENTION

Figure 2:
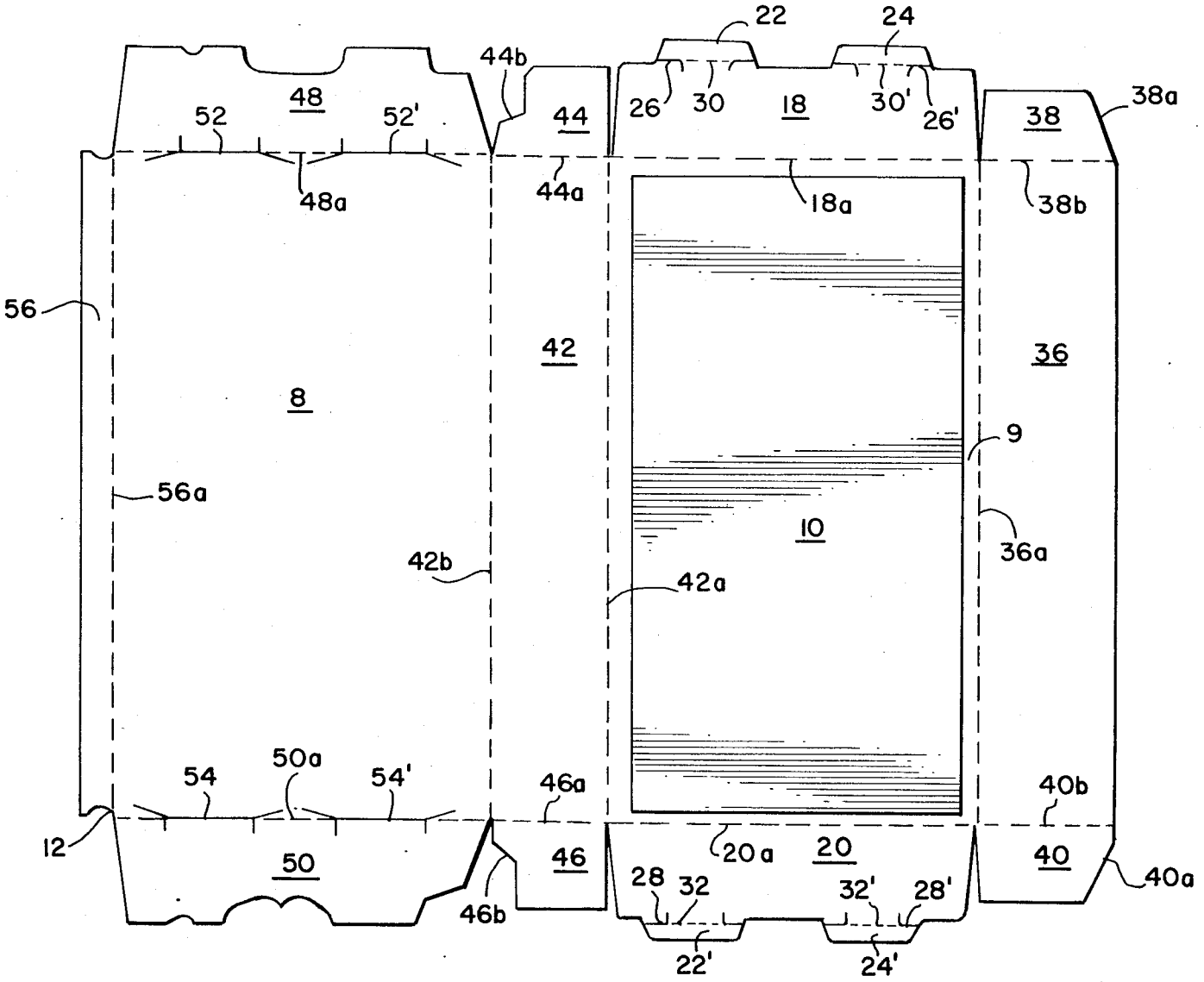
FIG. 2 is a plan view of a paperboard blank from which the outer carton of FIG. 1 may be formed.

For a clear understanding of the subject invention, reference is initially made to FIG. 2 in which a microwave food container 2 designed in accordance with the subject invention is illustrated. More specifically, the container 2 includes an outer carton 4 formed from a first paperboard blank and an insert 6 formed from a second paperboard blank and a microwave transparent tray. The outer carton 4 serves to protect the food during shipment and to crisp and brown the top crust of the food during its exposure to microwaves for cooking. The outer carton 4 has dimensions which are particularly designed to accommodate larger pot pies, although it functions equally well with pot pies of all sizes, as well as with other food requiring browning and crisping on only one side, in which case the container may be redimensioned accordingly. In particular, container 2 includes bottom panel 8 for supporting insert 6 throughout the cooking process and a top panel 9 for supporting a crisping means 10 for browning and crisping the top crust 11 of a food product containing a filling 13 The top crust 11 of the food filling 13 contained in insert 6 is separated from the crisping means 10 by a distance "a" which is critical to the proper functioning of container 2. The need for vertical spacing "a", which forms an important part of the subject invention, is based on the discovery, as explained below, that crisping means 10 gains in effectiveness as it is moved out of direct face-to-face contact with the top surface of the food in insert 6 up to a certain point away from the crust, after which it begins to again lose effectiveness. The optimum distance, in the case of foods having a top crust, has been found to be a function of the thickness and formulation of the crust, the thickness and formulation of the filling and the amount by which the crust can be expected to rise.

The unique elements of container 2 will be better understood after an explanation of the production, erection, assembly and various special features of each of the three primary components making up container 2.

Outer carton 4 is formed from a unitary outer paperboard blank 12, a plan view of which is shown in FIG. 2. Paperboard has a number of desirable characteristics which make it ideally suited as the primary structural component of a disposable cook-in microwave container. In particular, paperboard is strong, microwave transparent, easily adapted to receive advertising display graphics and easily handled during container assembly. All of these advantages are enhanced when combined with its recycleability and biodegradability.

Referring more specifically to the blank of FIG. 2, it is apparent that the blank is cut and scored along two perpendicular sets of parallel lines to form a plurality of interconnected panels and flaps including the top panel 9 to which may be laminated the crisping means 10 for converting microwave energy into heat capable of browning and crisping the surface of food situated at distance a, as explained above, away from the crisping means 10. The crisping means 10 may be formed from a microwave interactive layer, such as disclosed in Canadian Pat. No. 1,153,069, issued Aug. 30, 1983, constructed from a metallized polyester which is laminated onto top panel 9. The microwave interactive layer operates without the need for adjacent, coextensive microwave reflective material. Therefore, the amount of microwave energy received by selective parts of the food product may be controlled. Further, the absence of an adjacent, coextensive reflective material allows the microwave interactive layer to receive microwaves on both its inner and outer surfaces from both inside and outside of the container. Scientific studies and computer models have established a relationship between the amount of microwaves absorbed by crisping means 10, a food surface, such as a doughy crust, placed a distance a away from crisping means 10 and food filling located below the food surface. For example, maximum absorption occurs in crisping means 10 when it is situated 2.7 centimeters away from the food surface while minimum absorption in the food surface and food filling occur at this same distance. Heat transfer between crisping means 10 and the food surface varies inversely with the square of the separation distance and is not altered significantly either by the overall system temperature, the distance of container 2 from the microwave source or the thickness of the food filling so long as it is in excess of 3 centimeters. However, the amount of energy absorbed by all three components, the crisping means 10, the top crust 11 and the food filling 13, does increase in a nearly proportional relationship to the thickness of the doughy crust, up to a thickness of 1 centimeter. Thus, the exact distance is determined by multiple factors. First, consideration is given to the desired thickness of the food surface to account for the microwave absorptive relationship discussed above. Second, some additional space is allowed in the separation of crisping means 10 from the top crust 11 to allow for expansion of the doughy crust as it cooks and loses moisture. Thereby, the doughy crust can be displaced and/or crack as it browns and crisps to achieve a natural appearance and texture. It is possible that the crust will actually contact the crisping means by the end of the cooking cycle since it may assume a domed appearance as it expands. Other factors, which have an effect on the optimum distance "a", include the thickness and formulation of the filling and the thickness and formulation of the doughy crust. Based on computer modeling of pot pies (discussed further below with respect to FIGS. 8*a*–8*g*) an optimum spacing for distance "a" given a pot pie having a top crust of 0.4 cm, a chicken-a-la king type filling of 3.18 cm in vertical height and an interactive layer as described below of 0.0003 cm was found to be up to, but no greater than, 2.7 cm.

Continuing with a detailed description of the blank of FIG. 2, two outer end panels 18 and 20 are connected along fold lines 18*a* and 20*a*, respectively, to top panel 9. Each outer end panel includes two tabs 22, 24, 22', and 24', respectively, defined by slit lines 26, 26', 28 and 28' and fold lines 30, 30', 32 and 32', respectively, for releasably maintaining the container in a closed condition as will be explained below. Top panel 9 is attached along fold line 36*a* to first outer side panel 36 which includes two opposed tabs 38 and 40. Each of the tabs 38 and 40 includes an outermost inwardly slanted edge 38*a* and 40*a* which permits easier closing of outer carton 4, as described below. On the edge opposite fold line 36*a*, top panel 9 is connected along fold line 42*a* to second outer side panel 42 to which two opposed tabs 44 and 46 are also foldably connected along lines 44*a* and 46*a*. Second outer side panel 42 is further foldably connected along fold line 42*b* to bottom panel 8 to which two inner end panels 48 and 50 are foldably connected along fold lines 48*a* and 50*a*. Each inner end panel 48 and 50 includes two sets of slit lines 52, 52', 54 and 54', respectively, scored therein, which, after erection of the outer carton 4 as described below, coincide with the tabs 22, 24, 22'and 24'. These slits separate to permit the tabs to enter and lock into place when outer carton 4 is erected. Inner end panels 48 and 50 and outer end panels 18 and 20 may all have the same vertical heights. Bottom panel 8 is further connected along fold line 56*a* to a glue flap 56 which is formed to be adhesively connected to outer side panel 36 to form a tubular outer carton 4.

The use of a single unitary blank design significantly reduces the complexity of forming outer carton 4 especially when the blank is prepared for shipment in a flattened condition to the point of packaging. To achieve this condition, glue flap 56 may be folded 180 degrees along line 56*a* to lie flat against bottom panel 8. Next, top panel 9 is folded 180 degrees along line 42*a* so that first outer side panel 36 is brought into overlying contact with glue flap 56. As a result of these operations, panel 36 and flap 56 may be connected together by use of adhesive, thermoplastic material or other type of suitable mechanical or chemical securing means applied prior to or simultaneously with the folding operations described above. Upon completion of these steps a flattened tube is formed which may be shipped from the point of manufacture of the outer carton 4 to a point of packaging at which the outer carton 4 may be erected, insert 6 may be inserted therein and outer carton 4 may be finally closed and shipped to points of purchase by the ultimate user.

Figure 1:
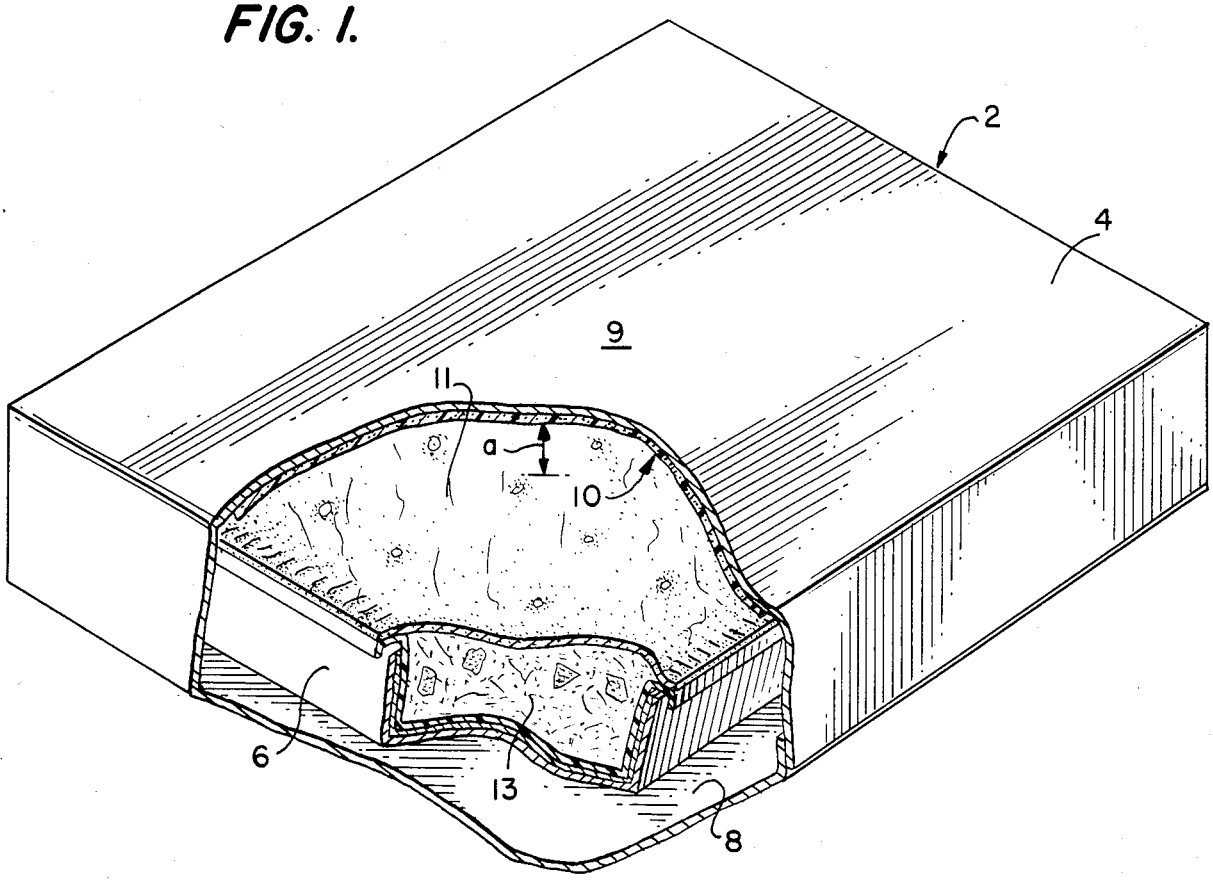
FIG. 1 is a cutaway perspective view of a preferred embodiment of a microwave package designed in accordance with this invention.
Figure 3:
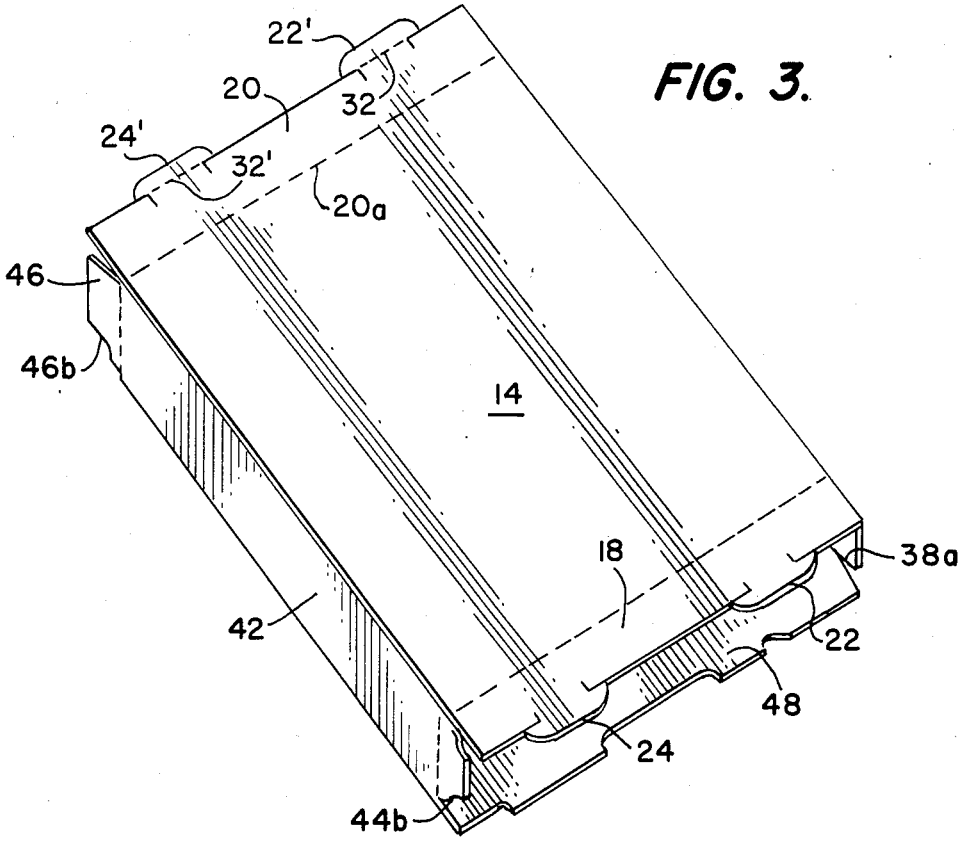
FIG. 3 is a perspective view of the outer carton of FIG. 2 after erection at the point of packaging.

FIG. 3 illustrates the configuration of outer carton 4 when it has been erected at the point of packaging in preparation for insertion of insert 6 which will be described in more detail below. In order to reach this next stage, the flattened tube resulting from the steps described above, is subjected to forces which cause second outer side panel 42 and adhered first outer side panel 36 (not illustrated) to assume positions which are perpendicular to top panel 9 and bottom panel 8 (not illustrted).

One end of outer carton 4 may be closed prior to insertion of the insert 6, although it is entirely possible to leave both ends open until insert 6 has been positioned within erected outer carton 4. It should be noted that the inward slanting portions 46b of tab 46 and 40*a* of tab 40 function to permit the tabs 22' and 24' to slide unobstructed into slits 54 and 54'. Similar slanted portions 38*a* and 44*b* perform similar functions in regard to tabs 22 and 24.

Figure 4:
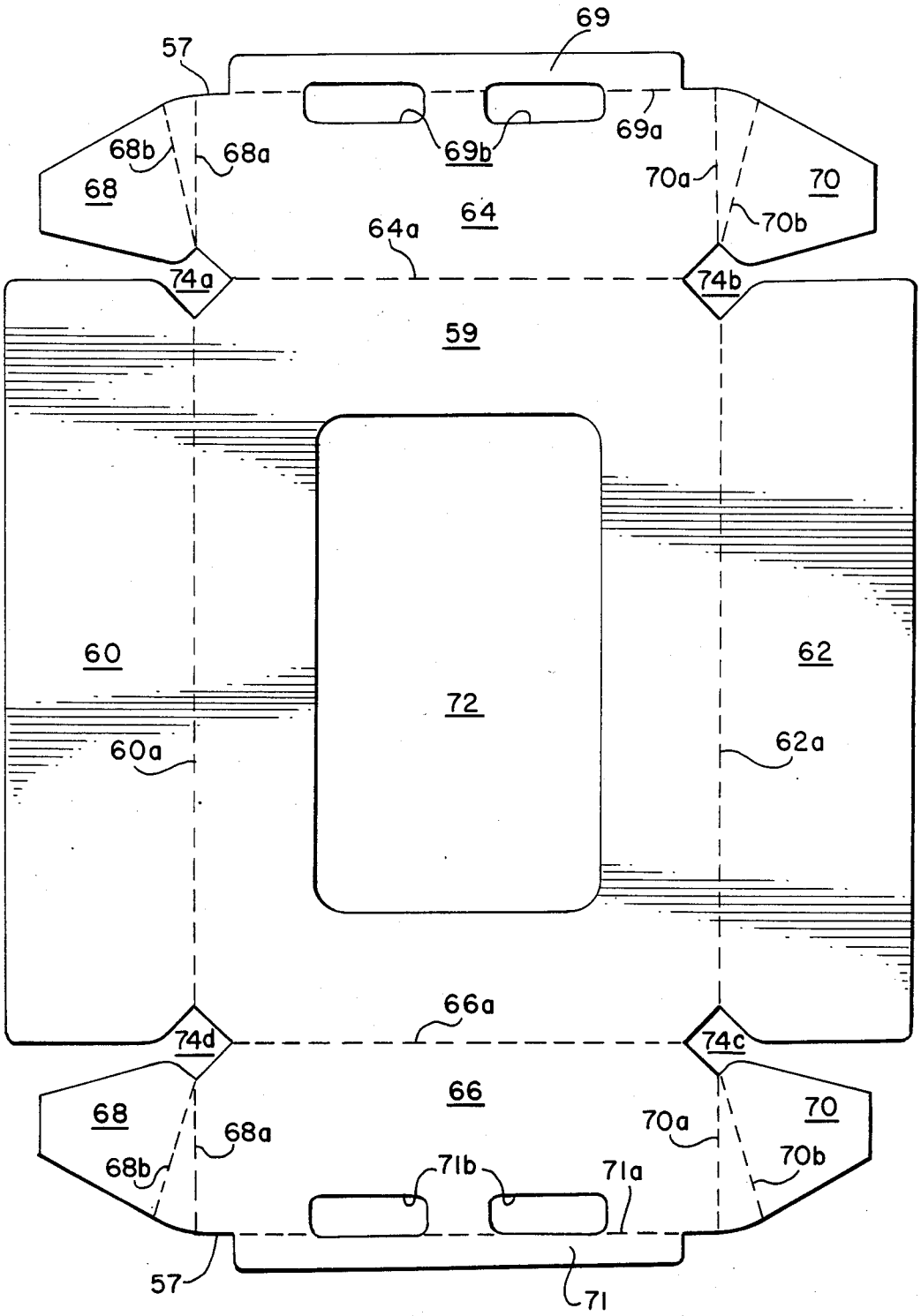
FIG. 4 is a plan view of the paperboard blank from which the support tray component of the insert of FIG. 1 may be formed.

Reference is now made to the configuration and method of assembly of insert 6. In particular FIG. 4 provides a plan view of a single unitary paperboard blank 57 which comprises one component of insert 6. When erected, blank 57 forms a support tray 58 (illustrated in FIG. 6). Blank 57 includes a central panel 59, two laterally opposed side panels 60 and 62 and two laterally opposed end panels 64 and 66, each of which includes a pair of laterally opposed sealing flaps 68 and 70 hingedly connected thereto along fold lines 68*a* and 70*a*, respectively. Support flaps 69 and 71, which function to facilitate assembly of the disclosed package as will be described below, are additionally hingedly connected to end panels 64 and 66 along fold lines 69*a* and 71*a*, respectively. Ideally foldline 69*a* and 71*a* are formed by a perforated line of through cuts. However, to avoid arcing caused by incident microwave energy when very little food is placed within the container, a pair of elongated holes 69*b* and 71*b* may be formed along foldline 69*a* and 71*b*, respectively, as illustrated in FIG. 4. End panels 64 and 66 are connected along fold lines 64*a* and 66*a* to central panel 59 while side panels 60 and 62 are connected, respectively, along fold lines 60*a* and 62*a* to central panel 59. Central panel 59 generally corresponds in shape with bottom panel 8 of outer carton 4. However, central panel 59 has both width and length dimensions which are noticebly less than the comparable dimensions of bottom panel 8. These lesser dimensions serve two functions. First, they allow insert 6 to be easily inserted into outer carton 4 from the end opening in outer carton 4 shown in FIG. 3 during the assembly process. Second, they allow both the end and side panels to assume an outwardly flared position with respect to central panel 59 after erection. This flare, in turn, permits easy insertion of a microwave transmissive tray into the support tray, as will be described below.

The entire interior surface of paperboard blank 57 is laminated with a microwave reflective material such as aluminum foil in order to act as a shielding means for the sides and bottom of the contents thereof from direct contact with microwave energy during the cooking process. Without some shielding, the sides of the food filling may absorb too much microwave energy and overcook, thereby releasing excessive moisture due to boiling of the filling contents. This results in unacceptable weight loss and an undesirable change in the filling texture. A total shield, however, causes the middle of the bottom portion of the food filling to remain unacceptably cold. Therefore, an opening 72 is cut in central panel 59 of paperboard blank 57 to allow a certain amount of energy to be directed into the bottom of insert 6 to provide the necessary heating. The size and shape of the hole depends on the filling formulation and the size of the bottom of support tray 58 and the microwave transmissive characteristics of the resulting central panel. For example, if the bottom is rectangularly shaped with dimensions of 13.335×9.207 centimeters, the appropriate hole size has been found to be 9.366×5.238 centimeters or approximately 40% of the total area of the bottom. Of course, the size and number of holes formed in panel 59 may be varied. In fact, the holes may be cut only in the aluminum layer leaving the paperboard of panel 59 intact. This combination of shielding and exposure, in conjunction with the browning and crisping of the top crust provided by the crisping means 10 of the outer carton 4, significantly improves the quality of food exposed to microwaves so that such food much more closely emulates the result of cooking the same food for a much longer period of time in a conventional oven. In addition, partial shielding provides the ability to control the amount of microwave energy entering and heating the food product independently from the heat generated by the microwave interactive layer.

To erect paperboard blank 57, tabs 68 and 70 are folded inwardly at slightly less than a 45 degree angle along fold lines 68*a* and 70*a* and are then folded a further approximately 45 degrees inwardly along fold lines 68*b* and 70*b*. Side walls 60 and 62 are folded inwardly somewhat less than 90 degrees along fold lines 60*a* and 62*a* until they come into face-to-face contact with the outer surface of tabs 68 and 70, respectively. An adhesive may be applied either to tabs 68 and 70 or to side walls 60 and 62 or to both panels prior to closing so that they remain in face-to-face contact. This results in the production of four beveled corner edges. Although not required, four diamond shaped areas 74*a*, 74*b*, 74*c* and 74*d*, may be cut out of paperboard blank 57 so that, after blank 57 is erected, a triangular opening remains at each bottom corner of the support tray 58. The trays are then stacked and delivered to the food packager for further handling.

Figure 5:
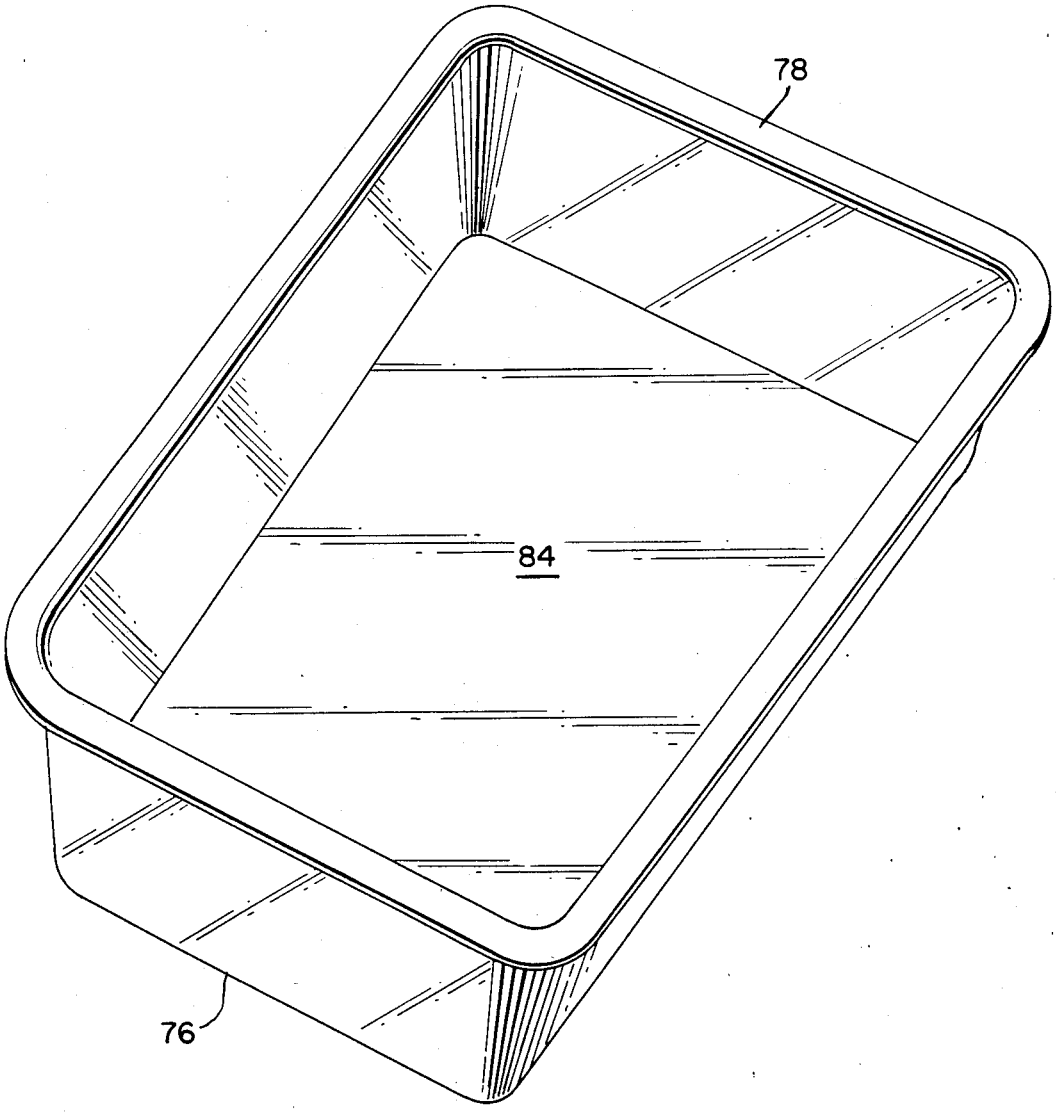
FIG. 5 is a perspective view of a microwave transparent tray designed to be inserted into the erected support tray of FIG. 4.
Figure 6:
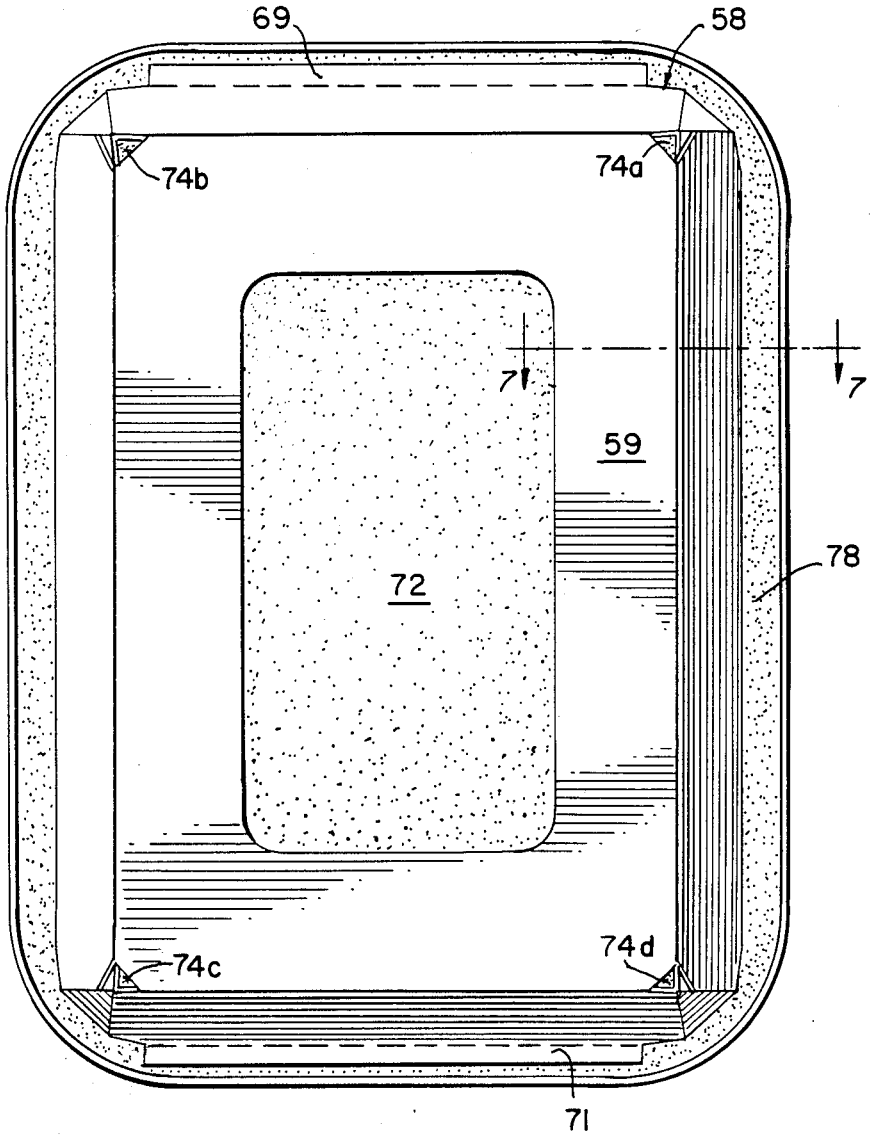
FIG. 6 is a bottom view of the insert of FIG. 1.
Figure 7:
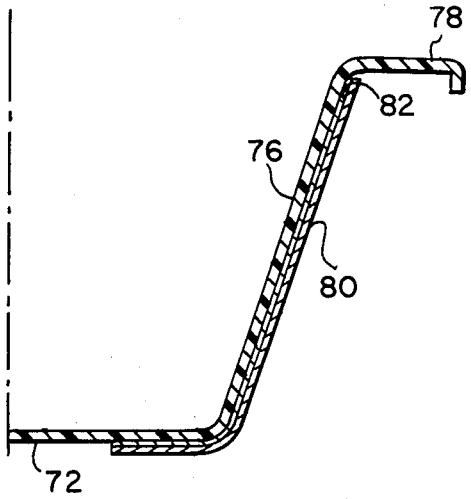
FIG. 7 is a broken away, inverted cross-sectional view of the insert of FIG. 6 taken along lines 7—7.

In preparation for reception of the microwave transparent tray to be discussed next, packaging support flaps 69 and 71 are folded outwardly at a 90 degree angle so as to form a lip on two sides of the support tray. The next step in the assembly of insert 6 requires that the support trays be placed in holes in an automated assembly line. Packaging support flaps 69 and 71 rest on solid material surrounding each such hole, thereby preventing the support tray from falling through the hole and allowing it to be transported along the assembly line to the point where the final step in the assembly of insert 6 occurs. For this step, a microwave transparent tray 76, as illustrated in a perspective view in FIG. 5, is needed. This microwave transparent tray may, for example, be formed from molded, microwave transmissive thermoplastic, although other materials may be used. Its length and width dimensions are such that it is designed to fit snugly within erected support tray 58, while its height dimension is designed so that it extends slightly above support tray 58 on all sides. The tray is filled with the desired food filling, such as a pot pie, by a food packager and is covered with an uncooked or partially cooked doughy crust. The crust extends from the central cavity of the tray over onto lip 78 of the tray which may extend radially outwardly for approximately 0.6 cm from the upper edges of the sidewalls of tray 76. This assembly is then exposed to extreme cold for freezing in a process already known. Thereafter, tray 76 is deposited in an automated fashion in support tray 58. A bottom view of insert 6 is illustrated in FIG. 6. A cross sectional view of insert 6 after these steps have been followed is shown in FIG. 7 in which plastic tray 76, its lip 78, the paperboard base 80 of support tray 58 and the aluminum foil laminate 82 covering the interior of paperboard base 80 are all visible. The material and configuration of tray 76 are functionally significant for several reasons. First, by using a rigid material, the lip 78 can be retained in a parallel relationship with the bottom 84 of the tray so that the doughy crust will also be approximately parallel to the bottom 84 across its entire surface, including the lip 78. Thereby, the critical relationship between the doughy crust and the crisping means 10 of outer carton 4 can be assured. In addition to the other problems of using a more flexible material which were discussed above, such a material might distort during the container assembly or cooking process so as to alter the critical distance "a" between the crust and the crisping means 10 resulting in either a scorched or uncooked crust or a combination of both problems. Also, a plastic tray is a relatively good insulator of heat so that when a pot pie has been cooked according to this invention, it may be removed from outer carton 4 and then from support tray 58, if desired, with less likelihood of experiencing discomfort from handling a hot packaging material. Finally, the plastic tray retains its shape and does not scorch or discolor from exposure to microwave energy, making it an aesthetically pleasing material to use in the serving of food.

To complete the assembly of a container in accordance with this invention, the insert 6 is slid into outer carton 4 through the remaining opening formed by inner end panel 48 and outer end panel 18. Finally, the open end or ends of outer carton 4 are closed by folding in tabs 44 and 38, folding upwardly inner end panel 48 along fold lines 48*a* and folding downwardly outer end panel 18 along fold line 18*a*. Tabs 22 and 24 are then inserted into slits 52 and 52' to lock the carton closed. A similar operation is performed to close the upper end of outer carton 4 if this has not already been done.

Container 2 is delivered to a customer as a sealed package containing refrigerated or frozened food filling, such as pot pie. In order to use it, the customer places the package so that the crisping means 10 is located at the top. In this way, the customer establishes the critical distance between the crisping means 10 and the doughy crust on the top of the food product. After exposure to microwave energy for approximately 8 to 12 minutes, the food is cooked and may be served by removing the container 2 from the oven, reopening the tabs, and removing insert 6 from inside of outer carton 4. Both outer carton 4 and insert 6 are totally disposable, so that the customer may save or throw them away, as desired.

While the above described insert is preferred, a different form of insert may be used for small pot pies without side and bottom crusts. In particular, the small pot pie may be placed directly in a paperboard tray fully lined, including the entire bottom surface, with aluminum foil. Alternatively, the paperboard tray may be replaced by a solid aluminum foil tray. No microwave transparent additional tray is needed. A doughy crust is then deposited on top of the food filling and the tray is frozen and packaged in an outer carton having a crisping means identical to that described in relationship to the preferred embodiment. The height of the tray must be carefully designed in relationship to the outer carton height so that the distance between the crisping means and the doughy crust is established at that critical distance which produces the proper crisping and browning effect without scorching and without excessive loss of heat. The cooking process in this case is, however, somewhat different. The pot pie is heated in the package assembly just as it comes from the freezer.

After a 5 to 7 minutes heating cycle, the insert is removed from the carton. At this point, the top crust is browned and similar to what develops in a conventional home oven after 40 to 45 minutes. Because the foil tray has shielded the filling, especially on the bottom it is necessary to heat the pot pie out of the outer carton for an additional 5 to 7 minutes. This drives heat down to the bottom of the pot pie while not overcooking the top crust. A satisfactorily cooked product can be produced in 10 to 15 minutes in a microwave oven using this second cooking method, as opposed to requiring 50 to 60 minutes in a conventional oven.

If a pot pie has side and bottom crusts, yet another alternative embodiment can be used to achieve a product superior to those available through cartons known in the prior art. It is difficult to obtain crisp and brown side and bottom crusts when a pot pie which is contained in either a plain paperboard or a foil-lined tray is exposed to microwave energy. Foil reflects the microwaves away from the side and bottom crusts while with paperboard the filling is overheated and starts to dehydrate even though the side and bottom crusts do not get hot enough to brown and crisp. Although it is known, as disclosed in the patent to Turpin (U.S. Pat. No. 4,190,757) to brown a surface of a food product by placing that surface adjacent to a lossy microwave energy absorber so that heat generated during exposure to microwaves will conductively brown the product, it has not been possible before this invention to also selectively crisp and brown all or portions of a separate surface which is not in adjacent contact with a microwave absorbent surface. In the third alternative embodiment of this invention, an outer carton is constructed with a crisping means as described with regard to the preferred embodiment. Then, a tray is constructed by pressing paperboard which has been lined with the same microwave interactive material as is used for the crisping means into the desired configuration, usually similar in shape to a round aluminum foil tray. This tray is subsequently filled with a food filling, covered with a doughy crust, packaged and frozen as above. The customer places a frozen package assembly into a microwave oven and exposes it to microwave energy for a single heating cycle lasting approximately 8 to 12 minutes. Since the crisping tray lining generates heat throughout the heating cycle, the pot pie food filling can be heated uniformly throughout and the side and bottom crust will be properly crisped. In addition, the top crust will be properly browned and crisped partially or in toto without scorching or dehydration since the crisping means may receive microwave energy both from the exterior and interior of the container and, due to the spacing of the crisping means in the outer carton from that crust, the dough may rise a small distance as it browns and crisps, thereby giving it a more natural appearance and avoiding the possibility of sticking and scorching which would arise if the crisping means of the outer carton were placed in direct contact with the top crust.

Figure 8A:
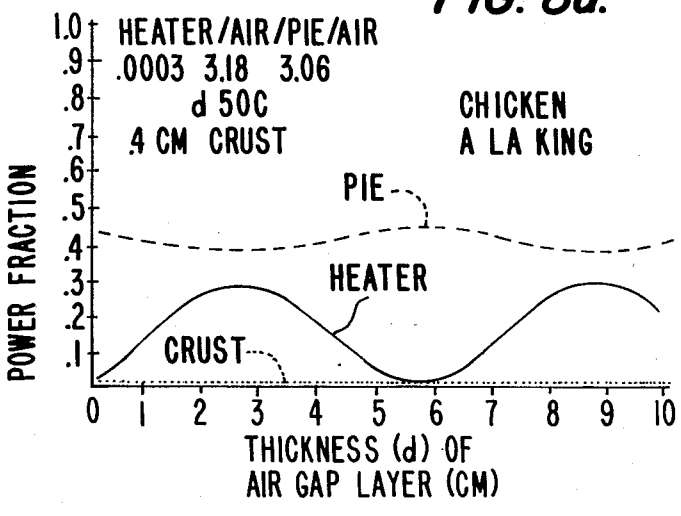
FIGS. 8*a*–8*g* are computer generated plots derived from a model of the microwave energy absorbed by the various absorbing layers of a container designed in accordnce with this invention.

Reference is now made to FIGS. 8*a*–8*g* wherein computer generated plots are illustrated to show the fraction of available power absorbed by the individual layers of the container. FIGS. 8*a*–8*e* correspond to a single top crusted pot pie with an interactive layer (heater) located above the crust. FIG. 8*a* shows how microwave absorption varies periodically with increasing spacing between heater and pie crust. For example, maximum absorption first occurs in the heater with a spacing of approximately 2.7 cm. Absorption in the pie filling and crust are a minimum at this same heater/crust spacing. Consideration of the fact that heat transfer between the heater and crust varies inversely with distance implies that some optimum spacing between heater and crust should exist, somewhere between 0 and 2.7 cm.

Figure 8B:
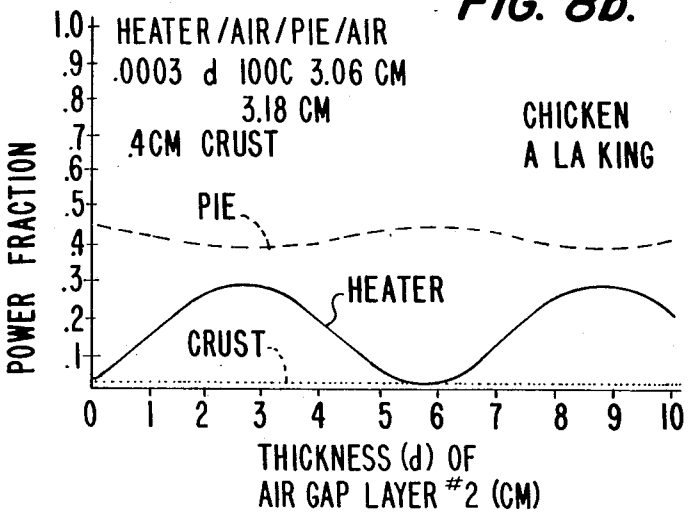

FIG. 8*b* is again similar to FIG. 8*a*. The difference being only that the system was characterized at 100° C. rather that at 50° C. as in FIG. 8*a*. The results indicate that little variation in system response occurs with temperature changes between these extremes.

Figure 8C:
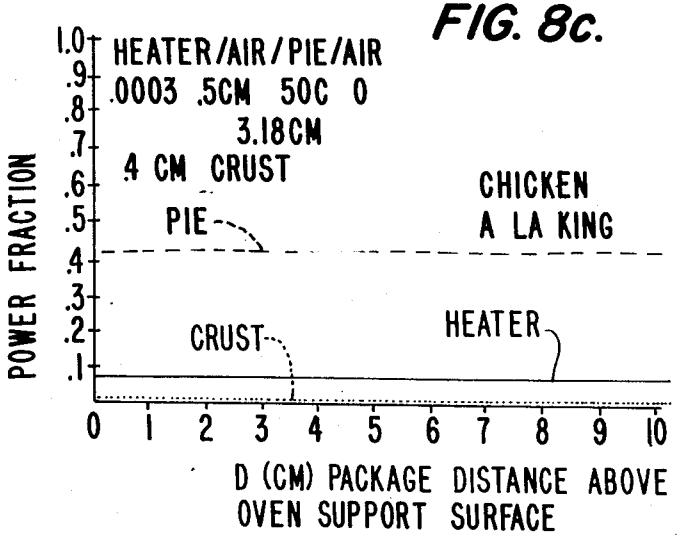

FIG. 8*c* is a plot of absorption vs. vertical location in the oven. It indicates that microwave absorption in the pie filling, crust and heater are relatively insensitive to vertical positioning of the container.

Figure 8D:
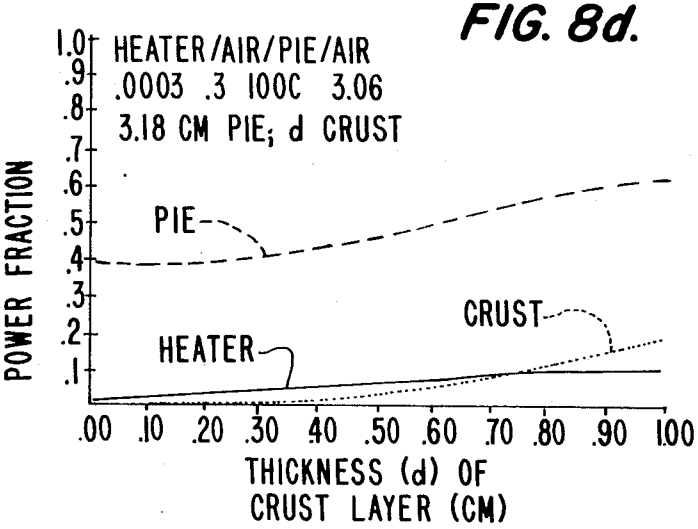

FIG. 8*d* is a plot of microwave power absorption in the pie filling, crust and heater vs. crust thickness. The results indicates that absorption by each of the three components increases as the crust thickness is increased between 0 and *1* cm.

Figure 8F:
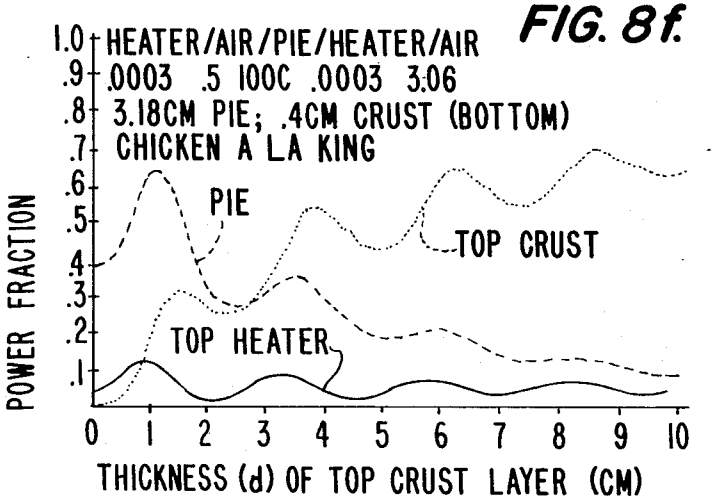
Figure 8E:
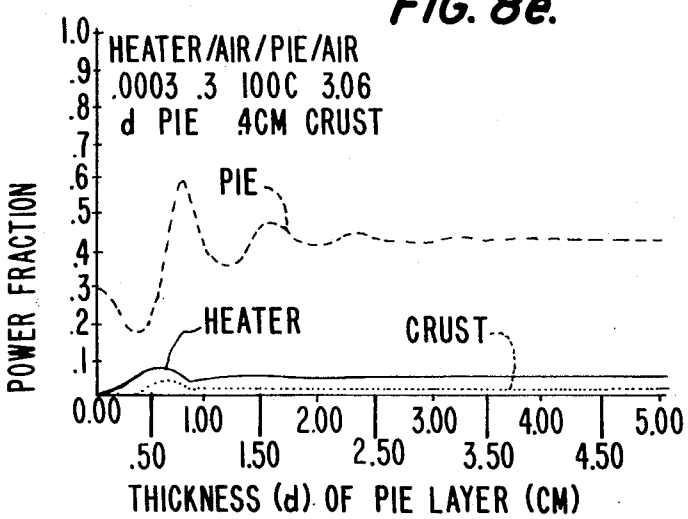

FIG. 8*e* looks at absorption in these same three components vs. pie filling thickness. The unusual behavior below 2 cm can be ignored for the bulk of the pie since pie thicknesses greater than 3 cm are typical. At pie filling thicknesses of 3 cm and greater, changes in pie filling thickness have no effect on the relative absorption in the different container/food components. On the other hand, model behavior for pie thicknesses less than 2 cm may explain what occurs toward the pie edge where pie thickness decreases as the periphery is approached.

Figure 8G:
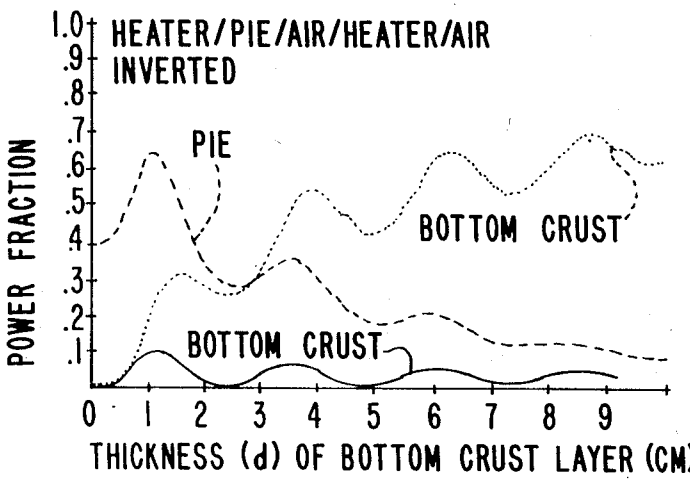

FIGS. 8*f* and 8*g* correspond to pot pies with both top and bottom crusts and top and bottom heaters. The plots show power fraction absorbed vs. top and bottom crust thickness respectively. FIG. 8*f* looks at radiation incident from above the package and FIG. 8*g* from beneath. These figures show that, in the range of reasonable crust thicknesses of less than 0.5 cm, pie filling, crust and heater all absorb increasing amounts of power as the crust thickness is increased. Both plots show that substantially all the radiation incident from a given side is absorbed before reaching the crust and heater on the opposite side.

INDUSTRIAL APPLICABILITY

The disclosed container and method finds particular utility for packaging of convenience foods such as meat and fruit pies for shipment and display in supermarkets and convenience stores, for cooking in microwave ovens and for serving in stores, restaurants and homes.

I claim:

1. A container for protection of a food product during shipment and for use in heating, crisping and browning the food product having a top surface in a microwave oven, comprising:

(a) an insert means for containing the food product, said insert means having a predetermined height; and (b) a microwave transmissive outer carton means for containing and supporting said insert means, said outer carton means having a cooking means for browning and crisping the top surface of the food product through radiated heat energy that includes a layer of microwave interactive material affixed to an underside of a top wall of said outer carton, and said outer carton means defining a receiving space for the insert means of a second predetermined height that is greater than the height of said insert means, in a manner coordinated to the food product intended for use therein, for causing said layer of microwave interactive material to be vertically spaced above the top surface of the food product by a vertical distance which maximizes the browning and crisping effect of said cooking means without overcooking or scorching the top surface of the food product, said vertical distance being no greater than approximately 2.7 cm.

2. A container as defined in claim 1, wherein said insert means is formed, at least in part, from a paperboard blank including a layer of aluminum foil which has been laminated to one surface thereof for shielding the contents thereof from direct exposure to microwave energy.

3. A container as defined in claim 1, wherein said insert means is comprised of a paperboard blank laminated with a microwave interactive layer for absorbing microwave energy and converting a portion of that energy into heat, having been pressed into said insert.

4. A container as defined in claim 1, wherein said insert means includes (a) microwave transparent tray means for containing said food product and for maintaining the top surface at a uniform distance away from said cooking means, and (b) shielding means associated with said microwave transparent tray means for independently controlling the amount of microwave energy reaching said microwave transparent tray means.

5. A container as defined in claim 4, wherein said microwave transparent tray means is thermoformed plastic.

6. A container as defined in claim 4, wherein said shielding means is formed of paperboard and aluminum foil laminated to one surface of said paperboard.

7. A container as defined in claim 4, wherein said shielding means is formed from a unitary inner blank having plural panels hingedly interconnected along foldlines and a layer of aluminum laminated to one surface of said unitary inner blank.

8. A container as defined in claim 7, wherein said panels of said unitary inner blank include:

(a) a central panel, said layer of aluminum covering only a portion of one surface of said central panel;

(b) a pair of side panels hingedly connected to said central panel;

(c) a pair of end panels hingedly connected to said central panel; and (d) two pairs of corner flaps, each pair of which is separately hingedly connected to opposite side edges of one of said end panels.

9. A container as defined in claim 8, wherein each said corner flap is hingedly connected by a pair of slightly divergent foldlines to cause a beveled corner to be formed upon erection of said inner blank and wherein a cut out opening is formed at each of the four corners of said central panel to form corner openings adjacent the bottom corners of said shielding means.

10. A container as defined in claim 8, wherein said portion of said central panel covered by said layer of aluminum is less than approximately 60% of the total area of said central panel.

11. A container as defined in claim 7 for a food product having a filling and a top crust, wherein said vertical distance the microwave interactive layer is vertically spaced from the food product is determined by the thickness of the top crust and by the amount the crust is expected to rise during exposure to microwave energy.

12. A container as defined in claim 11, where said microwave interactive layer is vertically spaced a maximum of 2.7 centimeters away from the top crust of the food product.

13. A container as defined in claim 1, wherein said outer carton means is formed from a unitary outer blank having plural panels hingedly interconnected along fold lines.

14. A container as defined in claim 13, wherein said unitary outer blank is formed of paperboard and said interactive layer is laminated to the inside surface of one of said panels.

15. A container as defined in claim 13, wherein said panels of said unitary outer blank include:

(a) a top panel;

(b) a pair of outer end panels hingedly connected to said top panel;

(c) first and second outer side panels hingedly connected to said top panel;

(d) bottom panel hingedly connected to said second outer side panel;

(e) a pair of inner end panels hingedly connected to said bottom panel; and (f) an inner side panel hingedly connected to said bottom panel.

16. A method for microwave heating, crisping and browning of food having a doughy crust on the top surface thereof comprising the steps of:

(a) forming a package for containing the food having a microwave interactive layer capable of converting microwave energy into heat connected to the underside of a top wall of the package and positioning food therein in a manner that the interactive layer is spaced a vertical distance above the top surface of the food, said distance being based on a determination of the thickness of the dough crust constituting the top surface of the food and the amount the doughy crust can be expected to be displaced during cooking;

(b) inserting said package into a microwave oven so that the top surface is oriented towards the source of microwave energy;

(c) exposing said package to microwaves;

(d) removing the food from said package; and (e) further exposing the food to microwaves to complete cooking of the food and the doughy crust.

17. A packaged food product for shipment and heating, crisping and browning in a microwave oven produced by the steps of:

(a) forming a package for containing the food having a microwave interactive layer capable of converting microwave energy into heat connected to the underside of a top wall of the package and positioning food therein in a manner that the interactive layer is spaced a vertical distance above the top surface of the food, said distance being based on a determination of the thickness of the dough crust constituting the top surface of the food and the amount the doughy crust can be expected to be displaced during cooking; and (b) sealing the package.

18. Packaged food product for shipment and heating, crisping and browning in a microwave oven, comprising:

(a) an insert means containing a food product with a top surface of the food product being disposed at predetermined height relative to a bottom surface of the insert means; and (b) a microwave transmissive outer carton means, said outer carton means having cooking means for browning and crisping the top surface of the food product through radiated heat energy that includes a layer of microwave interactive material affixed to an underside of a top wall of said outer carton, said outer carton means having an inner receiving space of a second predetermined height that is greater than said predetermined height of the top surface of the food product, said insert means containing said foot product being disposed in said inner receiving space with said layer of microwave interactive material being vertically spaced above said top surface of the food product by a vertical distance which maximizes the browning and crisping effect of said cooking means without overcooking or scorching the top surface of the food product, said vertical distance being no greater than approximately 2.7 cm.

19. Packaged food product for shipment and heating, crisping and browning in a microwave oven, comprising a food product, a microwave transmissive outer carton means having a cooking means for browning and crisping a surface of the food product through radiated heat energy that includes a layer of microwave interactive material affixed to an inner wall surface thereof, and support means supporting said food product within said outer carton means with a surface of the food product being disposed in an exposed facing relationship with respect to said microwave interactive layer wherein said surface is spaced from the microwave interactive layer by a distance which maximizes the browning and crisping effect of said cooking means without overcooking or scorching said surface of the food product, said distance being no greater than approximately 2.7 cm.

* * * * *